United States Patent [19]

Degner et al.

[11] Patent Number: 4,612,092

[45] Date of Patent: Sep. 16, 1986

[54] PREPARATION OF AROMATIC CARBOXYLATES

[75] Inventors: Dieter Degner, Dannstadt-Schauernheim; Eberhard Steckhan, Meckenheim; Karl H. Grosse-Brinkhaus, Steinfurt, all of Fed. Rep. of Germany

[73] Assignee: BASF Aktiengesellschaft, Ludwigshafen, Fed. Rep. of Germany

[21] Appl. No.: 781,354

[22] Filed: Sep. 27, 1985

[30] Foreign Application Priority Data

Sep. 27, 1984 [DE] Fed. Rep. of Germany ..... 3435388

[51] Int. Cl.[4] ..... C25B 3/02

[52] U.S. Cl. ..... 204/59 R

[58] Field of Search ..... 204/59 R

[56] References Cited

U.S. PATENT DOCUMENTS 4,148,696 4/1979 Halter ..... 204/59 R 4,284,825 8/1981 Degner et al. ..... 568/592

OTHER PUBLICATIONS

J. Chem. Soc. Perkin I, 1978, p. 708.

*Primary Examiner*—R. L. Andrews

*Attorney, Agent, or Firm*—John H. Shurtleff

[57] ABSTRACT

Aromatic carboxylates are prepared by electrochemical oxidation of the corresponding methyl benzenes or benzaldehyde dialkyl acetals in the presence of an alkanol and of a halogenated triarylamine derivative.

4 Claims, No Drawings

PREPARATION OF AROMATIC CARBOXYLATES

The present invention relates to a novel process for the preparation of aromatic carboxylates by electrochemical oxidation of benzene derivatives.

J. Chem. Soc. Perkin I, 1978, 708 and German Pat. No. 2,848,397 disclose that toluenes can be converted selectively to the corresponding benzaldehyde dimethyl acetals by anodic oxidation in the presence of methanol. However, electrochemical oxidation of the toluenes or of the benzaldehyde dialkyl acetals to the corresponding esters takes place with only very little selectivity, even when a very high excess current is used.

We have found that aromatic carboxylates of the general formula

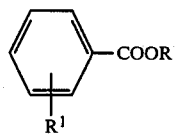

(I)

where R is alkyl of 1 to 4 carbon atoms and $R^1$ is hydrogen, halogen, alkyl, aryl, hetaryl, alkoxy, aryloxy, acyl, acyloxy or cyano, can particularly advantageously be prepared by electrochemical oxidation of a benzene derivative of the general formula

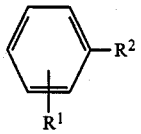

(II)

where $R^2$ is methyl or a radical of the formula —CH-$(OR)_2$ and R and $R^1$ have the above meanings, with an alcohol of the formula ROH, if the electrochemical oxidation is carried out in the presence of a triarylamine compound of the general formula

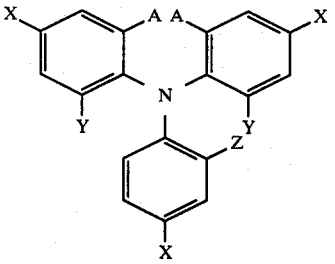

(III)

where the two radicals A either are each hydrogen or together form a single bond, X is halogen, $H_3COC$— or NC—, and Y and Z are each hydrogen or halogen. Surprisingly, the novel process gives the carboxylates with good selectivity.

In the benzene derivatives of the formula II, R is alkyl of 1 to 4 carbon atoms, preferably methyl or ethyl. Suitable radicals $R^1$, in addition to hydrogen and halogen, are alkyl radicals, for example those of 1 to 6 carbon atoms. Alkoxy is, for example, methoxy or ethoxy, aryl and aryloxy are, for example, phenyl and phenoxy, and acyl and acyloxy are, for example, —CO—$CH_3$ and —$COOCH_3$.

Examples of starting materials of the formula II are toluenes, such as toluene, o-, m- and p-xylene, 4-tert.-butyltoluene, 4-methoxytoluene, 4-chlorotoluene or 4-bromotoluene, or benzaldehyde dialkyl acetals, such as benzaldehyde dimethyl acetal, benzaldehyde diethyl acetal, 4-methylbenzaldehyde dimethyl acetal, 4-tert.-butylbenzaldehyde dimethyl acetal, 4-tert.-butoxybenzaldehyde dimethyl acetal, 4-methoxybenzaldehyde dimethyl acetal, 4-bromobenzaldehyde dimethyl acetal or 4-chlorobenzaldehyde dimethyl acetal. The preferred alkanol of the formula ROH is methanol.

Triarylamine compounds of the formula III are compounds of the formula

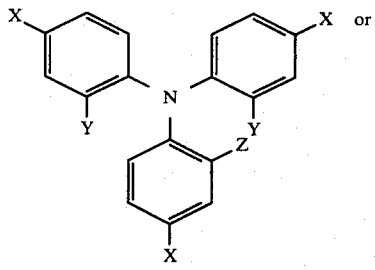

or IV

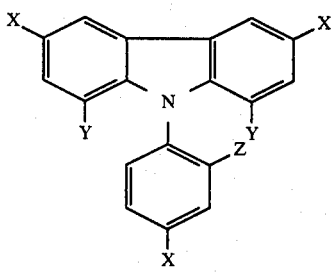

V

They contain as halogen atoms, for example, F, Cl or Br. Examples of compounds of the formula III are tris-(4-bromophenyl)-amine, bis-(4-bromophenyl)-(2,4-dibromophenyl)-amine, bis-(2,4-dibromophenyl)-(4-bromophenyl)-amine, tris-(2,4-dibromophenyl)-amine, tris-(4-chlorophenyl)-amine, bis-(4-chlorophenyl)-(2,4-dichlorophenyl)-amine, bis-(2,4-dichlorophenyl)-(4-chlorophenyl)-amine and tris-(2,4-dichlorophenyl)-amine, of which tris-(2,4-dibromophenyl)-amine and tris-(2,4-dichlorophenyl)-amine are preferred.

The novel process does not require any special electrolysis cell, but an unpartitioned continuous-flow cell is preferably used. The anodes employed may be of any conventional anode materials which are stable under the electrolysis conditions, such as noble metals, e.g. gold or platinum. Preferably, graphite or glass-like carbon is used. Suitable cathode materials include graphite, iron, steel, nickel and noble metals, such as platinum.

The electrolyte used in the electrochemical oxidation has, for example, the following composition:

from 1 to 70% by weight of a starting compound of the formula II from 30 to 96% by weight of an alkanol, with or without a cosolvent, from 0.5 to 5% by weight of a triarylamine compound of the formula III and from 0.5 to 4% by weight of a conductive salt.

Suitable conductive salts are those conventionally used in organic electrochemistry, e.g. salts of tetrafluoroboric acid, of alkyl- or arylsulfonic acids, of alkylsulfuric acids and of perchloric acid. In order to increase the solubility of the electron carrier, cosolvents may be added to the electrolyte. Examples of suitable cosolvents are halohydrocarbons, such as methylene chloride, dichloroethane or 1,2-dichloropropane, and nitriles, such as acetonitrile. The cosolvents are added to the alkanol in amounts of, for example, as high as 60 parts by weight per 100 parts by weight of alkanol.

Electrolysis is carried out at a current density of from 0.25 to 5, preferably from 0.5 to 3, A/dm$^2$.

The upper limit of the electrolysis temperature is determined by the boiling point of the alkanol or of the cosolvent. Advantageously, electrolysis is effected at, for example, 5°-10° C. below the boiling point of the electrolyte. Where methanol is used, electrolysis is carried out at, for example, no higher than 60° C., preferably from 20° to 60° C. Surprisingly, we have found that the novel process makes it possible to achieve substantial conversion of the benzene derivatives of the formula II without having an adverse effect on the selectivity of the electrochemical oxidation.

The reacted mixture from the electrolysis is worked up by a conventional method, advantageously by distillation. Excess alkanol and any cosolvent used are first distilled off, the conductive salt and the triarylamino compound are filtered off, and the aromatic carboxylates are purified by distillation. The alkanol, the cosolvent, the conductive salt and the triarylamino compound can be recycled to the electrolysis. After 2,500 regenerative cycles, no significant loss of triarylamine compound was observed.

The carboxylates obtainable by the novel process are scents and intermediates for dyes and drugs.

EXAMPLE 1

Electrochemical synthesis of methyl benzoate

| | |
|---|---|
| Cell: | Unpartitioned beaker cell with cooling jacket |
| Anode: | Cylinder of glass-like carbon, diameter = 26 mm, height = 50 mm. |
| Cathode: | Platinum wire |
| Starting materials: | 720 mg (1 millimole) of tris-(2,4-dibromophenyl)-amine<br>920 mg (10 millimoles) of toluene |
| Electrolyte: | 3:1 $CH_3OH/CH_2Cl_2$; 1.5% by weight $NaClO_4$; 0.7% by weight of tris-(2,4-dibromophenyl)-amine; 1% by weight of toluene |
| Current density: | From 0.5 to 0.7 A/dm$^2$ |
| Electrolysis: | Carried out using 15.5 F/mole of toluene |
| Temperature: | 30° C. |
| Working-up procedure: | The electrolysis solution is evaporated down to half its volume, 20 ml of water are added and the mixture is extracted with pentane in a perforator. The organic phase is dried, the pentane is removed in a rotary evaporator and the products are isolated and purified by distillation in a bulb tube apparatus. |
| Result: | |
| Conversion: | 80% |
| Yield | of methyl benzoate: 1.037 g ≙ 76% |
| Selectivity: | 95%. |

EXAMPLE 2

Electrochemical synthesis of methyl p-methylbenzoate

| | |
|---|---|
| Cell: | Unpartitioned beaker cell with cooling jacket |
| Anode: | Cylinder of glass-like carbon, diameter = 26 mm; height = 50 mm. |
| Cathode: | Platinum wire |
| Starting materials: | 720 mg (1 millimole) of tris-(2,4-dibromophenyl)-amine<br>1.06 g (10 millimoles) of p-xylene |
| Electrolyte: | 3:1 $CH_3OH/CH_2Cl_2$; 1.5% by weight of $NaClO_4$; 0.7% by weight of tris-(2,4-dibromophenyl)-amine; 1% by weight of p-xylene |
| Current density: | 0.5 to 0.7 A/dm$^2$ |
| Electrolysis | carried out using 9.7 F/mol of p-xylene |
| Temperature: | 30° C. |
| Working-up procedure: | The electrolysis solution is evaporated down to half its volume, 20 ml of water are added and the mixture is extracted with pentane in a perforator. The organic phase is dried, the pentane is removed in a rotary evaporator and the products are isolated and purifed by distillation in a bulb tube apparatus. |
| Result: | |
| Conversion: | 95% |
| Yield | of methyl p-methylbenzoate: 1.101 g ≙ 73% |
| Selectivity: | 77%. |

EXAMPLE 3

Electrochemical synthesis of methyl 4-tert.-butylbenzoate

| | |
|---|---|
| Cell: | Unpartitioned beaker cell with cooling jacket |
| Anode: | Cylinder of glass-like carbon, diameter = 26 mm, height = 50 mm. |
| Cathode: | Platinum wire |
| Starting materials: | 720 mg (1 millimole) of tris-(2,4-dibromophenyl)-amine<br>1.480 g (10 millimoles) of 4-tert.-butyl toluene |
| Electrolyte: | 3:1 $CH_3OH/CH_2Cl_2$, 1.5% by weight of $NaClO_4$; 0.7% by weight of tris-(2,4-dibromophenyl)-amine; 1.5% by weight of 4-tert.-butyltoluene |
| Current density: | From 0.5 to 0.7 A/dm$^2$ |
| Electrolysis | carried out using 11.1 F/mole of 4-tert.-butyltoluene |
| Temperature: | 30° C. |
| Working-up procedure: | The electrolysis solution is evaporated down to half its volume, 20 ml of water are added and the mixture is extracted with pentane in a perforator. The organic phase is dried, the pentane is removed in a rotary evaporator and the products are isolated and purified by distillation in a bulb tube apparatus. |
| Result: | |
| Conversion: | 98% |
| Yield | of methyl 4-tert.-butylbenzoate: 1.382 g ≙ 72% |
| Selectivity: | 73%. |

EXAMPLE 4

Electrochemical synthesis of methyl p-methylbenzoate

| | |
|---|---|
| Cell: | Unpartitioned beaker cell with cooling jacket |
| Anode: | Cylinder of glass-like carbon, diameter = 26 mm, height = 50 mm. |
| Cathode: | Platinum wire |
| Starting materials: | 720 mg (1 millimole) of tris-(2,4-dibromophenyl)-amine<br>1.66 g (10 millimoles) of 4-methylbenzaldehyde dimethyl acetal |
| Electrolyte: | 3:1 $CH_3OH/CH_2Cl_2$; 1.5% by weight of $NaClO_4$; 0.7% by weight of tris-(2,4-dibromophenyl)-amine; 1.6% by weight |

-continued

| | |
|---|---|
| | of 4-methylbenzaldehyde dimethyl acetal |
| Current density: | From 0.5 to 0.7 A/dm$^2$ |
| Electrolysis | carried out using 3.3 F/mole of 4-methylbenzaldehyde dimethyl acetal |
| Temperature: | 30° C. |
| Working-up procedure: | The electrolysis solution is evaporated down to half its volume, 20 ml of water are added and the mixutre is extracted with pentane in a perforator. The organic phase is dried, the pentane is removed in a rotary evaporator and the products are isolated and purified by distillation in a bulb tube apparatus. |
| Result: | |
| Conversion: | 87% |
| Yield | of methyl p-methylbenzoate: 1.28 g = 85% |
| Selectivity: | 98%. |

EXAMPLE 5

Electrochemical synthesis of methyl 4-tert.-butoxybenzoate

| | |
|---|---|
| Cell: | Unpartitioned beaker cell with cooling jacket |
| Anode: | Cylinder of glass-like carbon, diameter = 26 mm, height = 50 mm. |
| Cathode: | Platinum wire |
| Starting materials: | 720 mg (1 millimole) of tris-(2,4-dibromophenyl)-amine<br>2.24 g (10 millimoles) of 4-tert.-butoxybenzaldehyde dimethyl acetal |
| Electrolyte: | 3:1 $CH_3OH/CH_2Cl_2$; 1.5% by weight of $NaClO_4$; 0.7% by weight of tris-(2,4-dibromophenyl)-amine; 2.2% by weight of 4-tert.-butoxybenzaldehyde dimethyl acetal |
| Current density: | From 0.5 to 0.7 A/dm$^2$ |
| Electrolysis | carried out using 4 F/mole of 4-tert.-butoxybenzaldehyde dimethyl acetal |
| Temperature: | 30° C. |
| Working-up procedure: | The electrolysis solution is evaporated down to half its volume, 20 ml of water are added and the mixture is extracted with pentane in a perforator. The organic phase is dried, the pentane is removed in a rotary evaporator and the products are isolated and purified by distillation in a bulb tube apparatus. |
| Result: | |
| Conversion: | 96% |
| Yield | of methyl 4-tert.-butoxybenzoate: 1.86 g ≙ 89% |
| Selectivity: | 93%. |

EXAMPLE 6 (comparative experiment)

Electrochemical synthesis of methyl p-methylbenzoate

| | |
|---|---|
| Cell: | Unpartitioned beaker cell containing 11 bipolar graphite electrode |
| Anode: | Graphite |
| Cathode: | Graphite |
| Electrolyte: | 3204 g of $CH_3OH$<br>360 g (2.17 moles) of 4-methylbenzaldehyde dimethyl acetal<br>36 g of $KSO_3C_6H_5$ |
| Current density: | 3.3 A/dm$^2$ |
| Electrolysis | carried out using 10 F/mole of 4-methylbenzaldehyde dimethyl acetal |
| Temperature: | from 25 to 30° C.<br>The electrolyte is pumped through a heat exchanger at a rate of 200 l/h during the electrolysis. |
| Working-up procedure: | When the electrolysis is complete, methanol is distilled off under atmospheric pressure, the conductive salt is filtered off and the filtrate is subjected to fractional distillation under 2 mbar and at from 73 to 152° C. This gives 56.6 g of unconverted 4-methylbenzaldehyde dimethyl acetal as well as 21 g of methyl 4-methylbenzoate. |
| Result: | |
| Conversion: | 84% |
| Yield | of methyl 4-methylbenzoate: 6% |
| Selectivity: | 8%. |

We claim:

1. A process for the preparation of an aromatic carboxylate of the formula

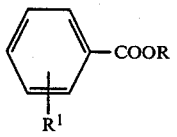

(I)

where R is alkyl of 1 to 4 carbon atoms and $R^1$ is hydrogen, halogen, alkyl, aryl, hetaryl, alkoxy, aryloxy, acyl, acyloxy or cyano, wherein a benzene derivative of the formula

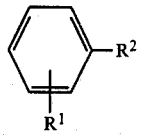

(II)

where $R^2$ is methyl or a radical of the formula —CH-$(OR)_2$ and R and $R^1$ have the above meanings, is subjected to electrolysis with an alcohol of the formula ROH in the presence of a triarylamine compound of the formula

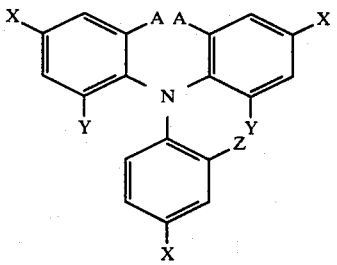

(III)

where the two radicals A either are each hydrogen or together form a single bond, X is halogen, $H_3COC$— or NC—, and Y and Z are each hydrogen or halogen, at a current density of from 0.25 to 5 A/dm$^2$ and at 5°-10° C. below the boiling point of the alcohol.

2. A process as claimed in claim 1, wherein the triarylamine compound used is tris-(2,4-dibromophenyl)-amine or tris-(2,4-dichlorophenyl)-amine.

3. A process as claimed in claim 1, wherein the electrolyte used contains from 1 to 70% by weight of a benzene derivative of the formula II, from 30 to 96% by weight of an alkanol, with or without a cosolvent, from 0.5 to 5% by weight of a triarylamine compound and from 0.5 to 4% by weight of a conductive salt.

4. A process as claimed in claim 1, wherein the alcohol used is methanol, and electrolysis is carried out at not more than 60° C.

* * * * *